US012312135B2

(12) United States Patent
Leeds et al.

(10) Patent No.: US 12,312,135 B2
(45) **Date of Patent: *May 27, 2025**

(54) CUP WITH INTEGRATED FOLDING LID

(71) Applicant: SOFI PAPER PRODUCTS, LLC, Miami Beach, FL (US)

(72) Inventors: Brandon Leeds, Miami Beach, FL (US); Jordan Leeds, Miami Beach, FL (US)

(73) Assignee: SOFI PAPER PRODUCTS, LLC, Miami Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/815,069

(22) Filed: Jul. 26, 2022

(65) Prior Publication Data

US 2022/0363433 A1 Nov. 17, 2022

Related U.S. Application Data

(63) Continuation of application No. 17/026,843, filed on Sep. 21, 2020, now Pat. No. 11,434,042.

(51) Int. Cl.
*B65D 5/64* (2006.01)
*B65D 3/04* (2006.01)
(Continued)

(52) U.S. Cl.
CPC ..... *B65D 5/64* (2013.01); *B65D 3/04* (2013.01); *B65D 5/4216* (2013.01);
(Continued)

(58) Field of Classification Search
CPC ..... B65D 5/64; B65D 3/04; B65D 5/4216; B65D 5/46072; B65D 65/42;
(Continued)

(56) References Cited

U.S. PATENT DOCUMENTS 5,358,175 A 10/1994 Cai
5,676,306 A 10/1997 Lankin et al.
(Continued)

FOREIGN PATENT DOCUMENTS

JP 57-175670 11/1982
JP 2003-72733 3/2003
JP 2007-15771 1/2007

OTHER PUBLICATIONS

International Search Report and Written Opinion for PCT/US2021/031042 (ISA/EP) mailed Jul. 23, 2021 (14 pages).
(Continued)

*Primary Examiner* — Christopher R Demeree
(74) *Attorney, Agent, or Firm* — ALSTON & BIRD LLP

(57) ABSTRACT

Embodiments provide a cup with an integrated lid that comprises top, center, and bottom portions. The top portion of the cup defines an opening and is attached to a plurality of integrated lid sections extending from the top portion and separated from the top portion by one or more fold lines. The plurality of integrated lid sections may be folded inward over the opening defined by the top portion to cover and at least partially seal the opening. The center portion defines a sidewall that extends between two ends that are affixed to at least each other. The bottom portion extends from the center portion and defines a base. The plurality of integrated lid sections may interlock to define a lid. The lid may be configured with a hole or spout for drinking or pouring the contents of the cup. The base, sidewall, and lid may define a frustoconical shape.

17 Claims, 11 Drawing Sheets

(51) Int. Cl.
*B65D 5/42* (2006.01)
*B65D 5/46* (2006.01)
*B65D 65/42* (2006.01)
*B65D 81/38* (2006.01)

(52) U.S. Cl.
CPC ..... *B65D 5/46072* (2013.01); *B65D 65/42* (2013.01); *B65D 81/3853* (2013.01); *B65D 81/3858* (2013.01)

(58) Field of Classification Search
CPC .. B65D 81/3853; B65D 81/3858; B65D 3/20; B65D 3/06; B65D 1/265; B65D 81/3865
USPC ..... 229/403, 402, 404, 906.1, 128, 138, 5.5, 229/4.5
See application file for complete search history.

(56) References Cited

U.S. PATENT DOCUMENTS 5,740,058 A 4/1998 Cai
5,960,987 A 10/1999 Solland et al.
6,176,420 B1 * 1/2001 Sarson ..... B65D 3/20 229/404
6,257,485 B1 7/2001 Sadlier et al.
6,592,504 B2 7/2003 Sarson
D495,209 S * 8/2004 Tranfaglia ..... D7/509
6,955,289 B2 10/2005 Green
7,681,784 B2 3/2010 Lang
7,726,551 B2 6/2010 Abbott
8,505,807 B2 * 8/2013 Herman ..... B31B 50/26 229/5.5
9,321,551 B2 4/2016 Lu
2002/0052286 A1 * 5/2002 Sarson ..... B65D 3/20 493/480
2004/0011862 A1 * 1/2004 Sarson ..... B65D 3/20 229/404
2005/0173507 A1 * 8/2005 Green ..... B65D 43/162 229/404
2009/0261153 A1 10/2009 Abbott
2012/0286027 A1 * 11/2012 Lu ..... B65D 3/06 229/404
2012/0292382 A1 11/2012 Cai
2013/0299567 A1 * 11/2013 Herman ..... B65D 1/265 229/404
2013/0334297 A1 * 12/2013 West ..... B65D 3/20 229/404
2014/0042217 A1 * 2/2014 Houck ..... B65D 3/06 229/404
2015/0097026 A1 * 4/2015 Lu ..... B65D 3/30 229/404
2015/0272361 A1 * 10/2015 Herman ..... B65D 3/06 220/717
2019/0077536 A1 * 3/2019 Chan ..... B65D 3/04

OTHER PUBLICATIONS

U.S. Appl. No. 17/026,843, filed Sep. 21, 2020, 2022/0089313, Allowed.
Office Action for Japan Patent Application No. 2022-569194 dated Nov. 16, 2023 w/English translation (5 pages).
Final Office Action for Japan Patent Application No. 2022-569194 dated May 20, 2024, w/English translation (5 pages).

* cited by examiner

CUP WITH INTEGRATED FOLDING LID

CROSS-REFERENCE TO RELATED APPLICATIONS

This application is a continuation of U.S. patent application Ser. No. 17/026,843, filed on Sep. 21, 2020, the contents of which are hereby incorporated by reference in their entirety.

TECHNOLOGICAL FIELD

An example embodiment relates generally to foldable containers.

BACKGROUND

Disposable cups are widely used throughout the food service industry from fast food service restaurants to school cafeterias. Such cups are made of paper or plastic material configured to contain either hot or cold beverages. Traditional disposable cups are configured to accept separate plastic lids that conform to the top of the cup by snapping in place over a rolled edge. The lids may be configured with a hole to drink from directly, such as coffee cup lids, or to accept a separate straw, for example soda fountain cup lids. Food service facilities are often equipped with individual fixtures to house disposable cups, lids, and straws individually in order to be dispensed to an employee or an end user for assembly. Additionally, food service facilities utilize conventional non-water tight paper containers for food products. Conventional plastic containers, or plastic lids with paper containers, are utilized for containing food products prone to leakage.

SUMMARY

Embodiments of the present disclosure are directed to a cup with an integrated folding lid. The inventors have identified problems associated with traditional disposable cups and propose an integrated lid and cup to overcome these identified problems. Traditional disposable cups require at least a separate plastic lid which snaps over the opening of the traditional cup by holding onto a rolled edge of the cup with tabs configured around a mating surface on the lid. These tabs may not fit the cup properly creating a loose lid to cup interface leading to leaking or spillage. Another issue associated with traditional disposable cup lids is that they can split or break if a user attempts to remove the lid. For example, if a user removes a lid to refill the cup, or add ice, then the lid may tear, bend, or otherwise break requiring a new lid. It will be appreciated, in light of the present disclosure, that such traditional plastic disposable lids unnecessarily add to increased garbage production and waste. Moreover, in instances that a disposable cup contains a hot beverage a loose or broken lid may lead to injury, for example, burns on the skin, when a user attempts to drink from the lid. Traditional disposable cups, lids, and straws also place additional logistical burdens on the food service industry and suppliers thereof. For example, traditional disposable cups, lids, and straws are often produced in separate facilities and are required to ship individually to a supply distributor or a restaurant directly. Additionally, the restaurants must allocate additional employee hours to inventory and track cup, lid, and straw quantities individually for each cup size offered.

The same aforementioned limitations are also associated with conventional take-out food containers which suffer from further limitations. For example, conventional take-out food containers are either of a folding paper type, which are not water tight due to a folded bottom, or of a cup and lid combination (e.g., paper and/or plastic soup or beverage cup and lid combinations). Further, conventional take-out food containers of the folding paper type (e.g., Chinese food takeout containers, etc.) are often restricted to square or rectangular cross-sectional geometries only and are not suited for cup holders, or the like (e.g., insulation sleeves, koozies, etc.). Additionally, such conventional folding paper type containers cannot be assembled and stacked for easy accessibility by a consumer. For example, traditional soda fountain cups are often stacked (e.g., a series of cups are inserted over each other) next to a soda fountain for a consumer, or food service employee, to easily access a cup and fill it at the soda fountain. Conventional folding paper type containers are prone to folding in on themselves when unfilled and therefore cannot be easily stacked over each other without binding and tearing when a consumer, or food service employee, goes to separate the conventional folding paper type containers. Conventional folding paper type containers therefore place an additional time and manpower burden on food service facilities because the Conventional folding paper type containers have to be assembled on a per order basis. Further, in instances where a food order contains multiple food types a combination of conventional folding paper type and conventional cup and lid containers must be used (e.g., an order containing rice and soup). It will be appreciated, in light of the present disclosure, that a food service facility must commit additional resources to store, assemble, track, and reorder a plurality of conventional container types.

The present disclosure proposes to solve at least the aforementioned problems associated with conventional folding paper type containers, and conventional cup and lid containers, through the provision of a cup with an integrated lid. The integrated lid may be configured with a portion of the lid configured to consume liquid therethrough further removing the need for a separate straw in some embodiments.

An example embodiment comprises an enhanced integrated cup with an integrated lid that is assembled by folding a continuous piece of material, such as paper, cut into a pre-configured shape (i.e. a blank). In such embodiments, the enhanced integrated cup comprises one or more of a base, a sidewall, an integrated lid section, a tab and slit, a fold line, or an adhesive. In some embodiments, the base may be a separate piece of material attached to a bottom portion of the sidewall, for example, by way of an adhesive (e.g., epoxy, etc.). In some embodiments, the base may comprise the same material as the sidewall and integrated lid components of the enhanced integrated cup. In some embodiments, the cup with the integrated lid may be at least partially assembled before reaching an end user (i.e., a consumer). For example, the cup may be shipped to a restaurant with a base and sidewall folded together and attached by way of an adhesive in order to maintain a substantially recognizable cup shape with an open top. In such embodiments, integrated lid sections may extend upward from at least an upper portion of the sidewall and at the transition region between the sidewall and the integrated lid sections one or more fold lines are configured. The one or more fold lines are configured to provide for the folding of the integrated lid sections over the opening of the cup to substantially form a covering (i.e., lid) over the opening of the cup without the need for a separate lid component. In some embodiments, at least a portion of the integrated lid may form a hole configured for drinking. In such embodiments, at least a portion of the integrated lid may protrude to define a spout configured to receive a straw, to drink from directly, or to pour out contents of the cup.

In some embodiments, the continuous piece of material used to make the enhanced integrated cup blank may comprise one or more materials including, without limitations, paper, plastic, foams, fabrics, the like, or combinations thereof. In some embodiments, the one or more materials may be at least partially treated with sealants to block the absorption of fluid into the material and thereby prevent leakage from the enhanced integrated cup. In some embodiments, only the interior of the cup's side wall and base may be treated with sealant. In other embodiments, all exposed surfaces of the enhanced integrated cup may be treated with sealant. In yet other embodiments, no sealant may be utilized. Sealants may include, without limitation, one or more of a natural coating, a synthetic coating, a plastic-free coating, polylactic acid (PLA), wax (e.g., paraffin wax, beeswax, etc.), resin, epoxy, petroleum-based coating (e.g., polyethylene, etc.), the like, or combinations thereof. In some embodiments, it will be appreciated that a plastic free coating may be applied such that the drink is allowed to be fully contained without seepage for up to 6 hours. In some embodiments, a paper material used to produce the enhanced integrated cup blanks may comprise a single sheet of paper, multiple sheets of paper overlaid and attached to each other (e.g., by way of adhesives, a lamination process, etc.), one or more sheets of cardboard, the like, or combinations thereof. For example, in an instance the enhanced integrated cup is intended for cold drink products (e.g., iced tea) the material may comprise a single sheet of paper coated with PLA to prevent liquid absorption into the paper material. In an alternative example instance, wherein the enhanced integrated cup is intended for hot drink products (e.g., coffee), the material may comprise cardboard treated with a wax coating. In some embodiments, cardboard materials may be configured with one or more channels between at least two surfaces and the space within the channels may be configured to insulate the sidewalls of the enhanced integrated cup. It will be appreciated, in light of the present disclosure, that wax and PLA based sealants may be utilized to improve the biodegradability of the enhanced integrated cup.

In other embodiments, a plastic material used to produce the enhanced integrated cup blanks may comprise one or more sheets of a thermoplastic, a thermoset, polyethylene terephthalate (PETE), high-density polyethylene (HDPE), low-density polyethylene (LDPE), polypropylene (PP), polycarbonate (PC), silicone, polylactic acid (PLA), the like, or combinations thereof. In some embodiments, the enhanced integrated cup may be repeatedly washed and reused by a consumer. For example, the enhanced integrated cup may be produced by means of injection molding utilizing a silicone material, or the like. In such example embodiments, the integrated lid of the enhanced integrated cup may be repeatedly opened and closed without substantial deterioration accumulating along one or more fold lines. It will be appreciated, in light of the present disclosure, that in at least such plastic embodiments the one or more fold lines are configured to function as living hinges configured for multiple reuses. In some embodiments, plastic materials may be configured with one or more channels between at least two surfaces and the space within the channels may be configured to insulate the sidewalls of the enhanced integrated cup.

It will be appreciated, in light of the present disclosure, that materials may be selected and/or configured based on one or more of their physical characteristics including, without limitation, color, thermal properties, chemical resistance, the like, or combinations thereof. In some embodiments, the thickness of a material may be increased or decreased to proportionally increase or decrease heat transfer therethrough. For example, a material thickness may be increased to insulate the enhanced integrated cup from heat transfer therethrough. In some embodiments, the enhanced integrated cup blank may comprise one or more thicknesses. For example, a sidewall portion of the blank may be configured with a first thickness while an integrated lid section may comprise a second thickness and a base section may comprise a third thickness.

According to an aspect of the present disclosure, there is provided a cup with an integrated folding lid. In embodiments, the cup with the integrated folding lid may comprise a body comprising one or more materials. The body may comprise one or more fold lines that when the body, or a portion thereof, is bent along the one or more fold lines the body may comprise, and/or define, a center portion, a circular bottom portion, a top portion, and/or a plurality of integrated lid sections. In embodiments, the center portion may define a sidewall. The sidewall may be configured as a single continuous surface looped over on itself to define, for example, one or more circular cross-sections. The sidewall may be configured to extend between a first end and a second end, the first end of the sidewall may be attached to the second end of the sidewall, for example, by mechanical and/or chemical means. In embodiments, the circular bottom portion extending from the center portion defining a base.

The circular bottom portion may be configured to extend from the sidewall in a first direction and may attach to a bottom edge. In embodiments, the top portion may define an opening configured to allow access into one or more cavities defined by at least the center portion. In embodiments, the plurality of integrated lid sections extend from the top portion of the cup. The individual sections of the plurality of integrated lid sections may be separated from the top portion by a respective fold line. The plurality of integrated lid sections may comprise at least one integrated lid section that may define at least a tab and at least one integrated lid section defining at least a slit. In embodiments, the slit may be configured to receive, therethrough, the tab. In embodiments, the plurality of integrated lid sections may be configured to interlock at least by way of the tab being received within the slit. The interlocked plurality of integrated lid sections may define a lid cover that may be configured to at least partially cover the opening.

In some embodiments, the sidewall and the base define a water tight retention cavity at least partially enclosed by the body. In some embodiments, the sidewall, the base, and one or more dividers, attached to the sidewall and/or the base, define a plurality of water tight retention cavities at least partially enclosed by the body. In some embodiments, the one or more dividers may be attached to the sidewall and/or the base by way of one or more mechanical and/or chemical means. In some embodiments, mechanical attachment means may comprise one or more of a lap seam, countersunk lap seam, outside lap seam, standing seam, flat lock seam, grooved flat lock seam, lap bottom seam, insert bottom seam, single bottom seam, crimp, the like, or combinations thereof. In some embodiments, chemical attachment means may comprise one or more of a reactive adhesive, a non-reactive adhesive, a natural adhesive, a synthetic adhesive, a polyurethane resin, a thermoset epoxy, a cyanoacrylate, a pressure-sensitive adhesive, the like, or combinations thereof.

In some embodiments, the one or more dividers may comprise the same one or more materials (e.g., paper, cardboard, sealant, etc.) as the body of the cup. In some embodiments, the one or more dividers may comprise a different one or more materials (e.g., paper, cardboard, sealant, etc.) as the body of the cup. For example, the body of the cup may comprise a cardboard material with a wax based sealant coating and the one or more dividers may comprise a single sheet of paper material with a polylactic acid based sealant. In some embodiments, the one or more dividers may divide the water tight retention cavity into a plurality of water tight retention cavities defining a series of concentric circles. In some embodiments, the one or more dividers may divide the water tight retention cavity into a plurality of water tight retention cavities defining a series of polygons (e.g., semicircles, squares, rectangles, half-circles, the like, or combinations thereof).

It will be appreciated, in light of the present disclosure, that the one or more dividers that define a plurality of water tight retention cavities may be used to separate a plurality of contents of the cup. For example, a cup may be divided into two water tight retention cavities, each cavity accessible via at least a respective spout configured to accept at least a straw, and each cavity may be at least partially filled with dissimilar beverages (e.g., cola, ginger ale, water, etc.). For additional example, a first cavity may retain a beverage while a second cavity may retain ice (e.g., in a circular concentric configuration, such that the ice is in an inner cavity while the beverage is in an outer cavity). It will be appreciated, in light of the present disclosure, that by separating the beverage and the ice, the beverage will not become diluted over time as the ice melts providing an improvement over conventional beverage and/or food containers. In some embodiments, the spout may be configured for pouring liquid from the cup. For example, embodiments of the present disclosure may be configured as disposable restaurant silverware such as milk pourers or water pitchers that are replaced for hygiene purposes when a table is cleaned and prepared for the next customer.

In some embodiments, the opening of the top portion is configured to receive at least a liquid substance, and/or a solid substance, therethrough to be retained within the water tight retention cavity. In some embodiments, the opening of the top portion is configured to receive one or more of a beverage, a food product, the like, or combinations, therethrough, to be retained within the water tight retention cavity.

In some embodiments, the interlocked plurality of integrated lid sections define a spout extending from, and extruding through, the lid cover, the spout configured to convey at least the liquid retained in the water tight retention cavity therethrough. In some embodiments, the spout defines a drinking opening and the drinking opening may be configured to receive one or more of a straw, a stirrer, or a utensil (e.g., spoon, fork, etc.). In some embodiments, the spout is positioned at a junction between the interlocked plurality of integrated lid sections and the sidewall. In some embodiments, the spout is positioned to extend perpendicular to a surface defined by the interlocked plurality of integrated lid sections. In some embodiments, the spout is a plurality of spouts that may be configured to access contents retained in one or more water tight retention cavities. In some embodiments, the spout defines one or more of an ovular cross-section, a circular cross-section, a rectangular cross-section, a square cross-section, a frustoconical shape, a conical shape, a cylindrical shape, or a parabolic shape.

In some embodiments, the spout may comprise a conical shape, or similar shape, without an opening. In such embodiments, the spout may further comprise one or more fold lines defining a circumference around one or more surfaces of the spout (e.g., one or more circumferential rings around the outer surface of the spout). In such embodiments, the one or more fold lines defining a circumference around one or more surfaces of the spout may be configured to be bent, folded, and/or torn to form the opening of the spout. For example, a conical shaped spout may be configured with a perforated line midway between the tip and base of the conical shape which may be torn to allow a consumer to drink from the cup. In an instance the perforated line only defines a partial length around a circumference of the conical shape then the tip portion of the conical shaped spout may be folded over to provide access to the spout's opening. It will be appreciated, in light of the present disclosure, that in such embodiments, a cup may be filled, such as by a fast food employee, and then the spout may be opened at a later time by a consumer, thus reducing the risk of intentional or unintentional contamination (e.g., airborne viruses, bacteria, etc.). Indeed, this marks an improvement over conventional cup, lid, and straw systems that require a straw either to be opened and placed in the cup by a fast food employee or to be left sealed and separate from the cup.

In some embodiments, the first end of the sidewall is attached to the second end of the sidewall by way of an adhesive or the like. In some embodiments, the first end of the sidewall is attached to the second end of the sidewall by way of one or more mechanical and/or chemical means. In some embodiments, mechanical attachment means may comprise one or more of a lap seam, countersunk lap seam, outside lap seam, standing seam, flat lock seam, grooved flat lock seam, lap bottom seam, insert bottom seam, single bottom seam, crimp, the like, or combinations thereof. In some embodiments, chemical attachment means may comprise one or more of a reactive adhesive, a non-reactive adhesive, a natural adhesive, a synthetic adhesive, a polyurethane resin, a thermoset epoxy, a cyanoacrylate, a pressure-sensitive adhesive (e.g., tape, etc.), the like, or combinations thereof. In some embodiments, the first end of the sidewall is attached to the second end of the sidewall by overlapping a first portion of the first end of the sidewall over a second portion of the second end of the sidewall. In some embodiments, the first end of the sidewall is attached to the second end of the sidewall by abutting a first edge of the first end of the sidewall against a second edge of the second end of the sidewall. In some embodiments, a strip of one or more materials (e.g., paper, wax sealant, an additional sealant layer, the like, or combinations thereof) may be configured to at least partially cover the seam defined by the attachment of the first end of the sidewall to the second end of the sidewall.

In some embodiments, the base is attached to the bottom edge associated with the third end of the sidewall by way of an adhesive, or the like (e.g., one or more mechanical and/or chemical means). In some embodiments, the base defines one or more of an ovular cross-section, a circular cross-section, a rectangular cross-section, a square cross-section, a frustoconical shape, a conical shape, a cylindrical shape, a parabolic shape, the like, or combinations thereof.

In some embodiments, the one or more fold lines comprise one or more of a perforation line, a creased line, a ridged line, a solid score line, or a dashed score line. In some embodiments, the one or more fold lines may comprise a string of one or more materials (e.g., fabric, paper, aluminum, the like, or combinations thereof) embedded in one or more portions of the cup (e.g., top portion, spout, sidewall, etc.). In such embodiments, the string is configured to be pulled (e.g., by an end extruding out from the one or more portions of the cup) and as the string is pulled it is further configured to at least tear a line, at least partially, through the one or more portions of the cup. For example, the interlocked plurality of integrated lid sections may be torn at least partially open by a string embed in an outer surface of the interlocked plurality of integrated lid sections to form a spout at a junction between the interlocked plurality of integrated lid sections and the sidewall.

In some embodiments, the plurality of integrated lid sections extend upward from the sidewall on a fourth end as one or more continuous extensions of the sidewall. In some embodiments, the at least one tab extends upward from a first integrated lid section of the plurality of integrated lid sections, and wherein the at least one slit comprises a cutout portion of a second integrated lid section of the plurality of integrated lid sections. In some embodiments, the one or more materials comprises one or more of a paper, a plastic, a metal, or a fabric material. In some embodiments, the one or more materials are at least partially coated in a sealant. In some embodiments, the sealant comprises one or more of a polylactic acid, wax, resin, the like, or combinations thereof.

In some embodiments, one or more portions of the cup (e.g., the sidewall, the plurality of integrated lid sections, the base, etc.) comprise a thermal insulation. In some embodiments, the thermal insulation comprises a plurality of layers of the one or more materials configured with at least a space therebetween. In some embodiments, the thermal insulation comprises a thermal insulator material comprising one or more of polystyrene insulation, synthetic fibers, natural fibers (e.g., cotton, etc.), cork, corrugated materials (e.g., paper, cardboard, fiberboard, etc.), air, the like, or combinations thereof. In some embodiments, the space between the plurality of layers of the one or more materials is filled with one or more of air, foam, plastic, a vacuum, the like, or combinations thereof. It will be appreciated, in light of the present disclosure, that refrigeration systems for cooling beverages or producing ice are energy intensive and, therefore, by configuring the cup with one or more thermal insulation methods the need for additional ice/cooling is reduced thus reducing overall energy consumption.

In some embodiments, a portion of the cup including, without limitation, one or more of the center portion, the bottom portion, the top portion, or the like may comprise a graphical design print. In some embodiments, the graphical design print comprises one or more of an image, logo, text, numbers, geometric shapes, other aesthetic features (e.g., colors, etc.), the like, or combinations thereof. In some embodiments, the graphical design print comprises one or more of ink, scorched or burnt portions of material (e.g., such as by a laser engraver), a plastic overlay (e.g., vinyl sticker, polylactic acid adhered to an underlying material, etc.), the like, or combinations thereof. In some embodiments, the graphical design print indicates a location of the one or more fold lines along the body. In some embodiments, the graphical design print indicates a direction and/or order to fold the plurality of integrated lid sections. In some embodiments, at least the center portion defines one or more of a frustoconical shape, a conical shape, a cylindrical shape, or a parabolic shape.

In some embodiments, at least the center portion defines one or more diameters perpendicular to at least an outer surface of the sidewall, and the one or more diameters are configured to fit a plurality of cup holders. In some embodiments, at least the center portion is configured with a step-wise profile defined by a series of decreasing outer sidewall diameters. For example, a lower half of the center portion may define a first diameter and an upper half of the center portion may define a second diameter, wherein the first diameter is less than the second diameter. In some embodiments, one or more of the sidewall diameters may be configured to fit in one or more different types of cup holders, cup sleeves, cup koozies, the like, or combinations thereof.

In some embodiments, the spout may be configured with an integrated straw (e.g., a paper or plastic straw mechanically or chemically attached to one or more individual sections of the plurality of integrated lid sections, etc.). In some embodiments, the integrated straw may be configured by folding one or more individual sections of the plurality of integrated lid sections. In some embodiments, the integrated straw may be configured as a portion of the sidewall, the base, and one or more dividers, attached to the sidewall and/or the base. For example, a circular divider attached to the sidewall (e.g., by mechanical or chemical means) may extend from the top portion of the cup (e.g., a predefined distance above the plurality of integrated lid sections through the spout, etc.) down the sidewall to a predefined distance above the base of the cup. It will be appreciated, in light of the present disclosure, that the integrated straw negates the need for a separate supply of individually packaged straws at a food service facility, thus reducing operating costs for the facility while simultaneously reducing environmental impacts from additional straws and straw wrappers (e.g., a plastic straw in a paper or plastic hygiene sleeve).

In some embodiments, one or more folding handles may be configured to attached to the outer surface of the sidewall via mechanical and/or chemical means. For example, a pair of folding integrated handles may be at least partially glued to the exterior of the sidewall and be configured to bend away from the sidewall along one or more fold lines to produce at least one handle for carrying or holding the cup by hand. In some embodiments, the sidewall may be configured with one or more extruded tabs, affixed to the exterior of the sidewall by mechanical and/or chemical means, and configured with one or more slits to receive one or more tabs associated with one or more carrying handles. In such embodiments, the one or more carrying handles may comprise one or more materials and may be attached to the sidewall, or the like (e.g., one or more integrated lid sections of the plurality of integrated lid sections), by a first end of the carry handle and a second end of the carry handle is configured with a tab to interlock with one or more extruded tabs comprising a slit, or the like, (e.g., one or more integrated lid sections of the plurality of integrated lid sections).

In some embodiments, a handle, carrying handle, the like, or combinations thereof may be configured with a pressure sensitive adhesive configured to attach to one or more portions of the cup. For example, a carry handle may be configured with a first piece of pressure sensitive adhesive (e.g., tape, etc.) at a first end and a second piece of pressure sensitive adhesive at a second end and may be attached by a food service employee, or a consumer, to the sidewall or integrated lid of the cup. It will be appreciated, in light of the present disclosure, that some example handles, or the like, configured with pressure sensitive adhesive may be separate from some embodiments of the cup (e.g., an optional peripheral features that may or may not be utilized by a consumer)

or may be attached to the cup during initial assembly of the cup. In some embodiments, one or more handles may be integrated into the plurality of integrated lid sections to extend from a first integrated lid section and fold over to define the handle by interlocking with a second integrated lid section (e.g., via a tab and slit configuration, etc.).

Various other aspects are also described in the following detailed description and in the attached claims.

BRIEF DESCRIPTION OF THE DRAWINGS

Figure 1:
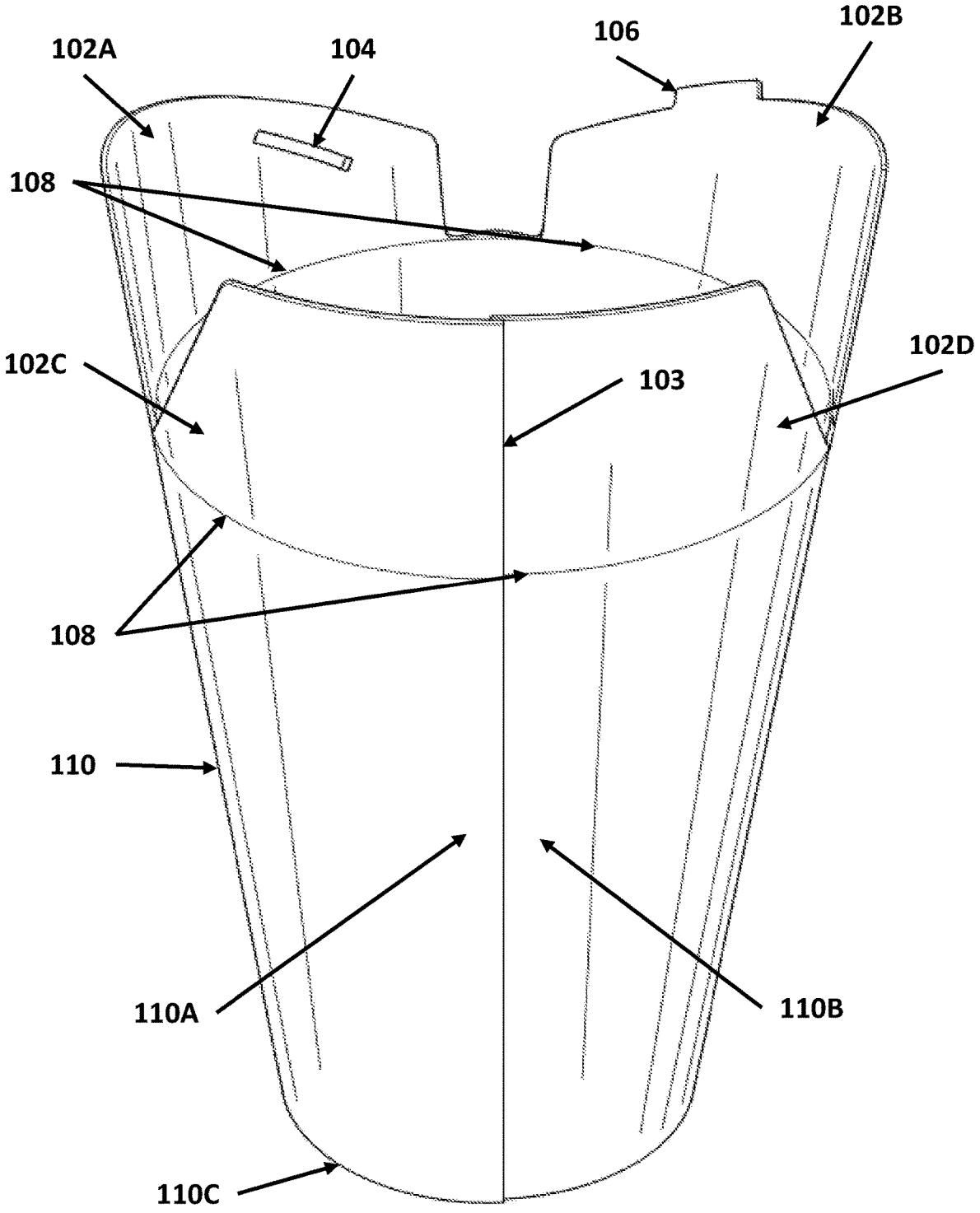
Figure 2:
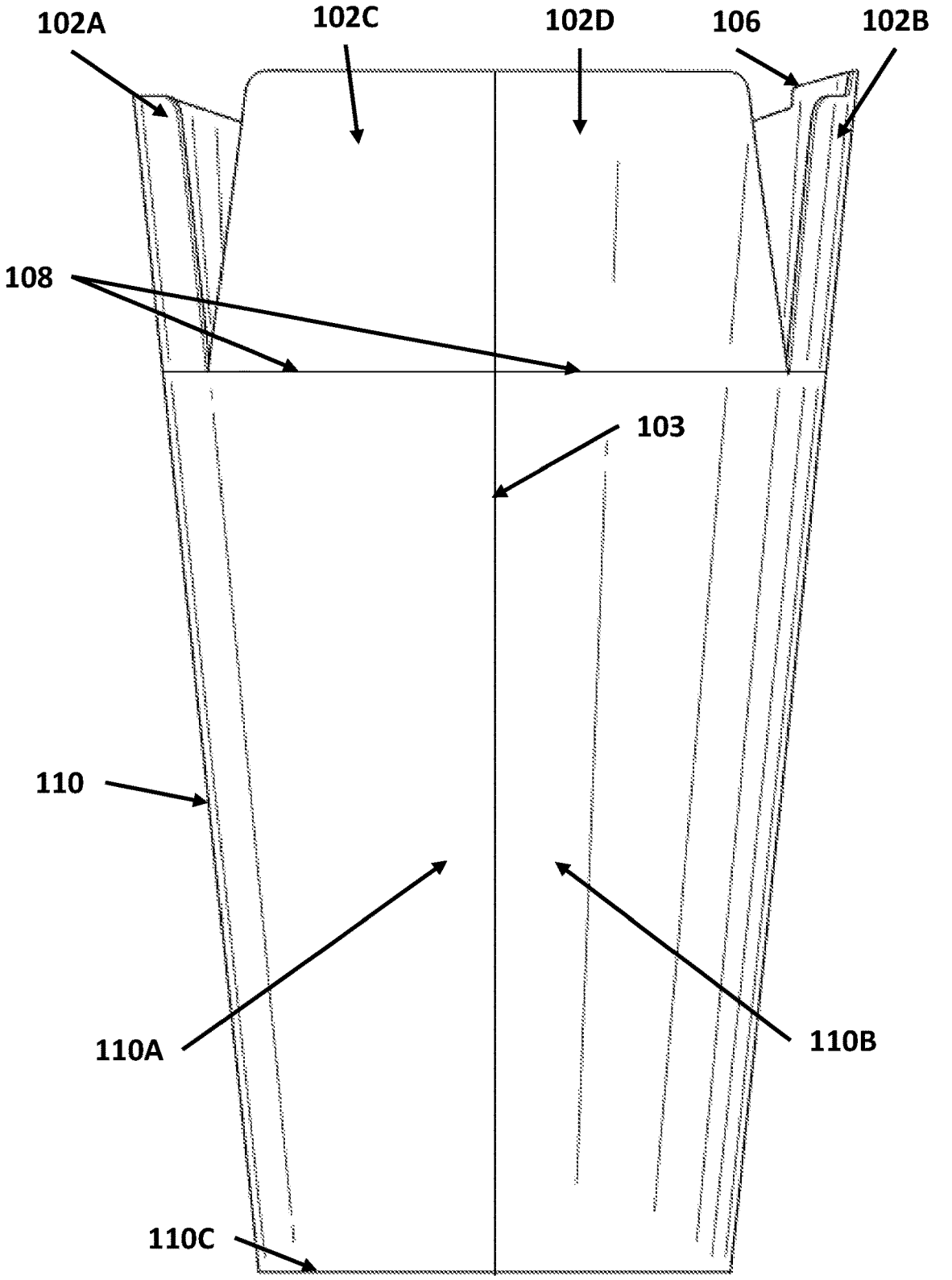
Figure 3:
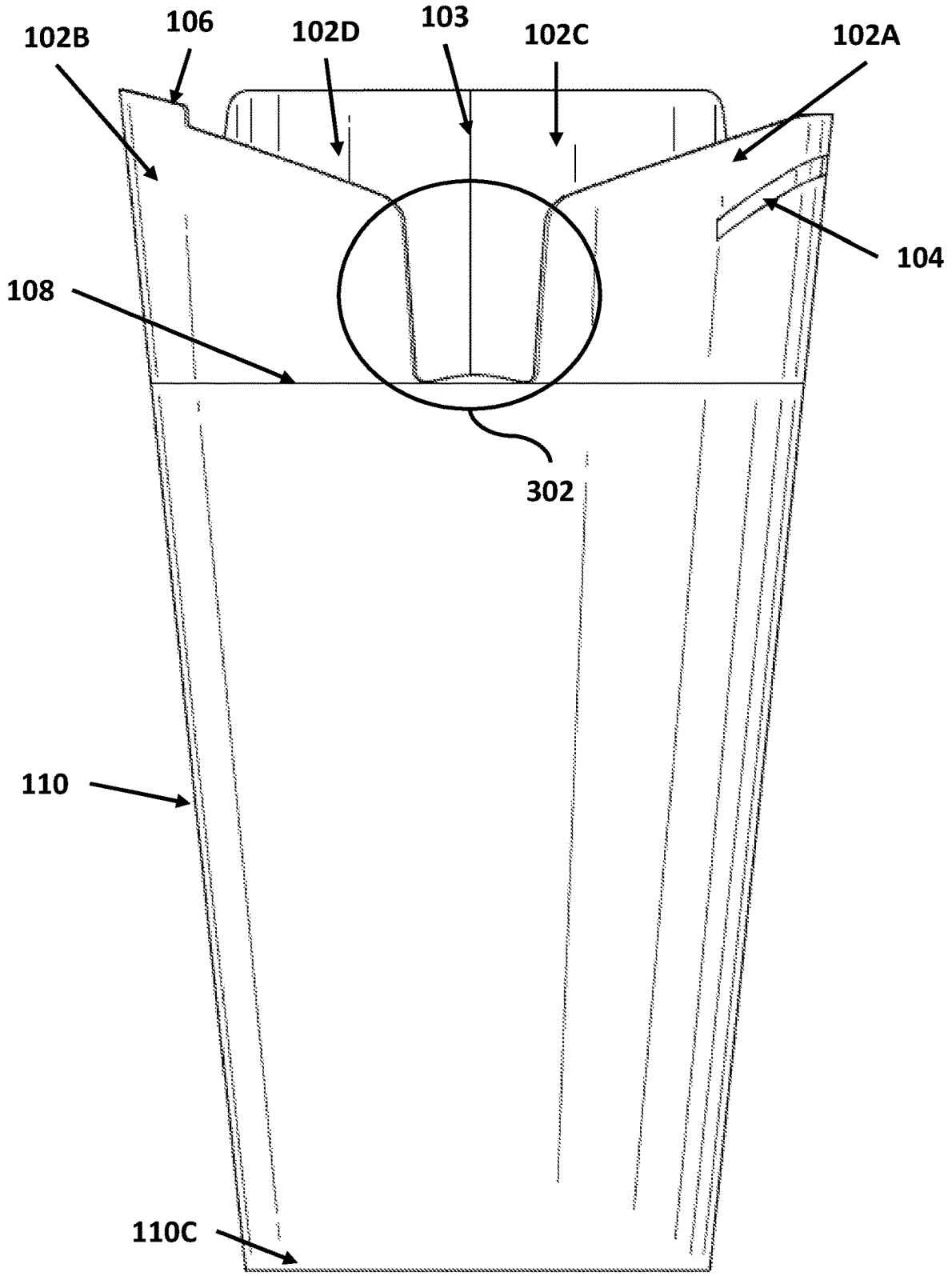
Figure 4:
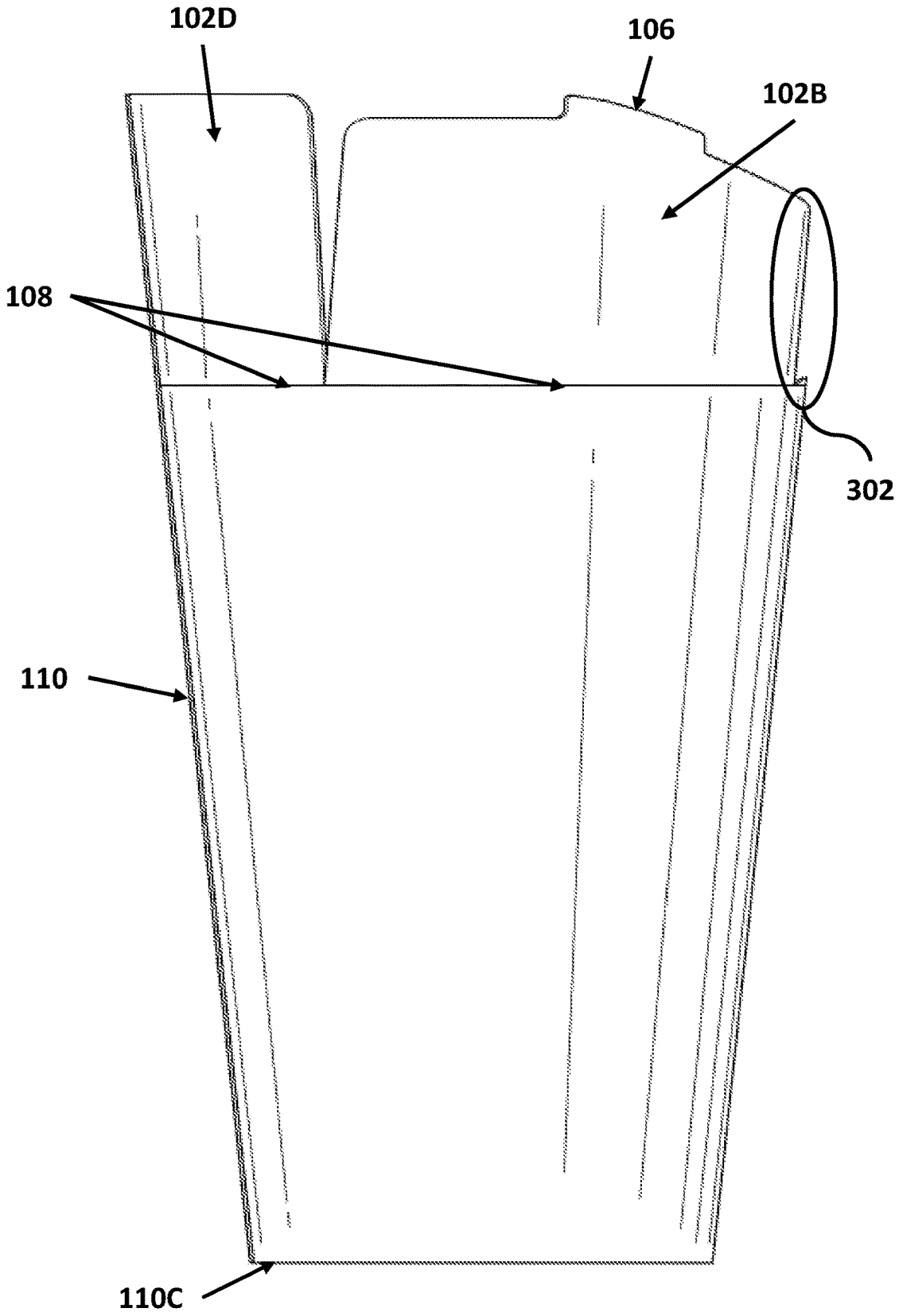
Figure 5:
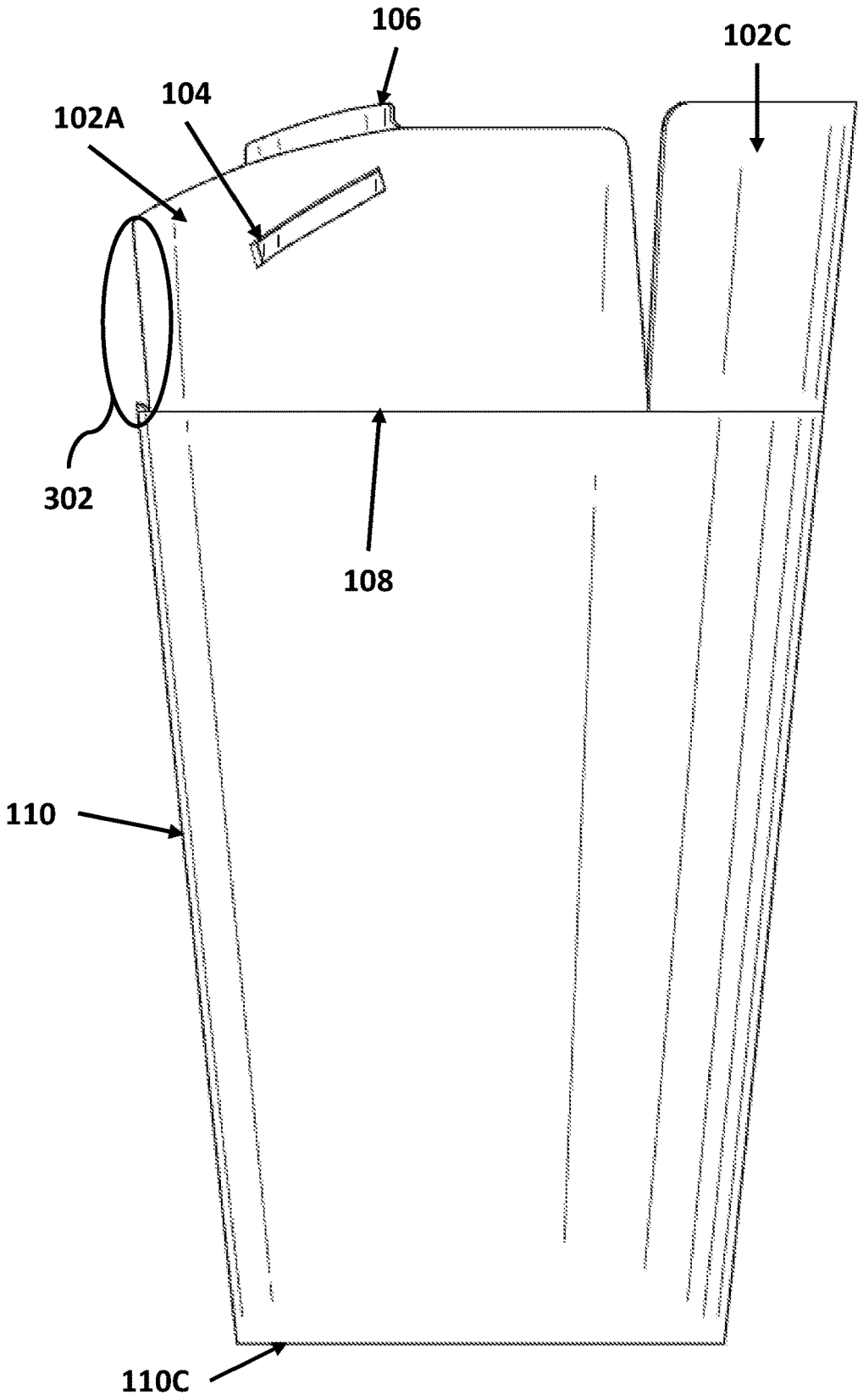
Figure 6:
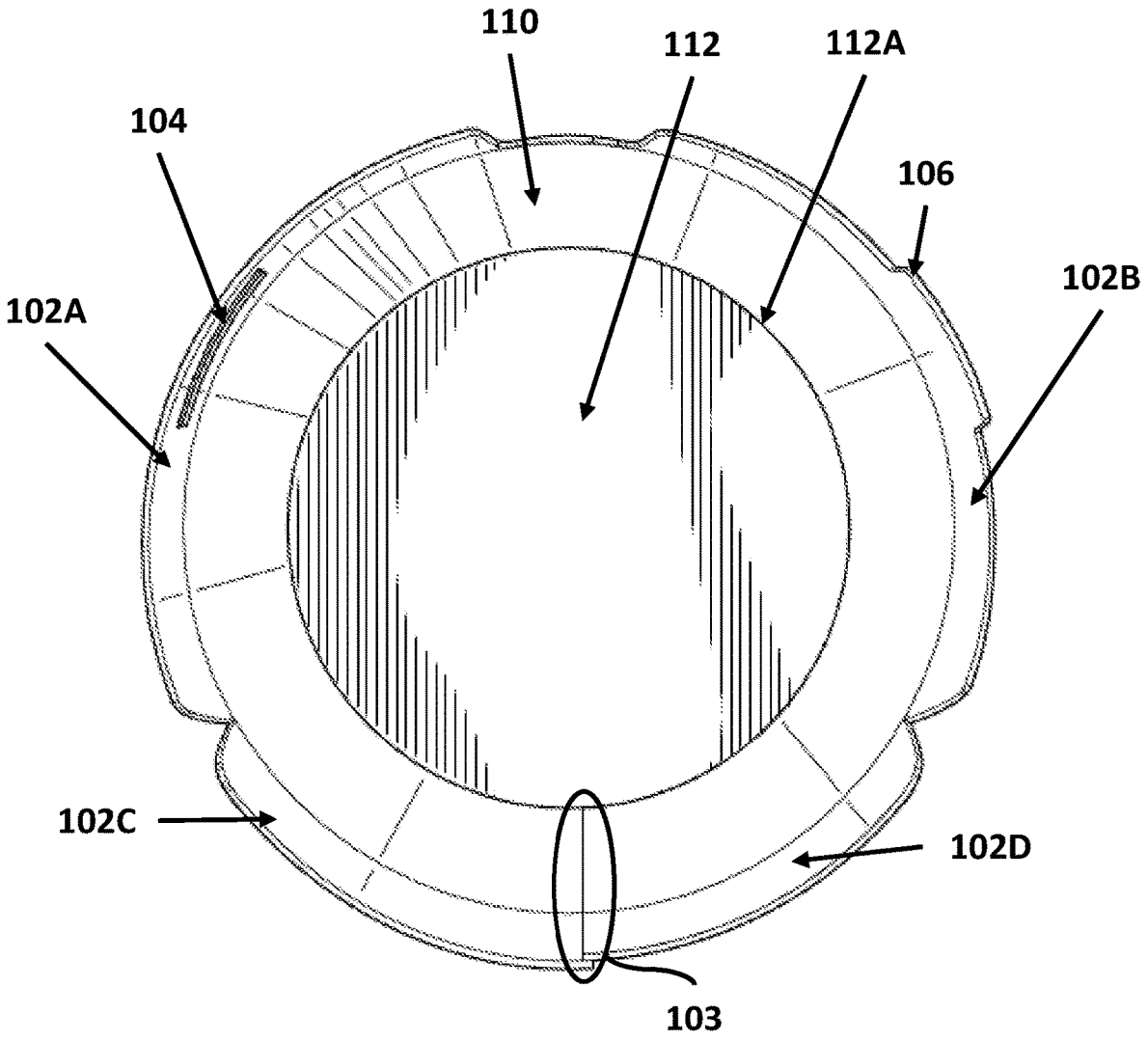
Figure 7:
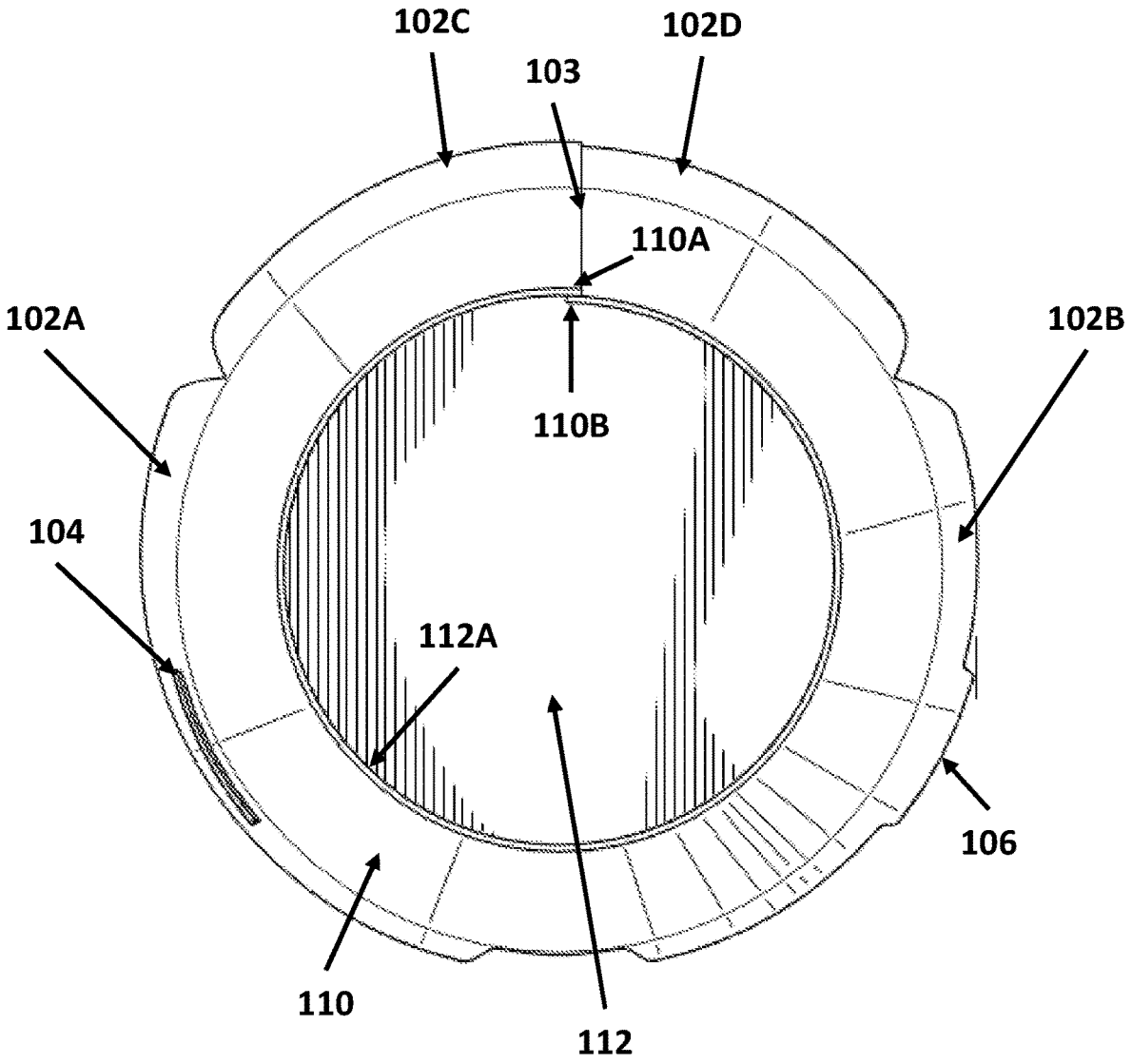
Figure 8:
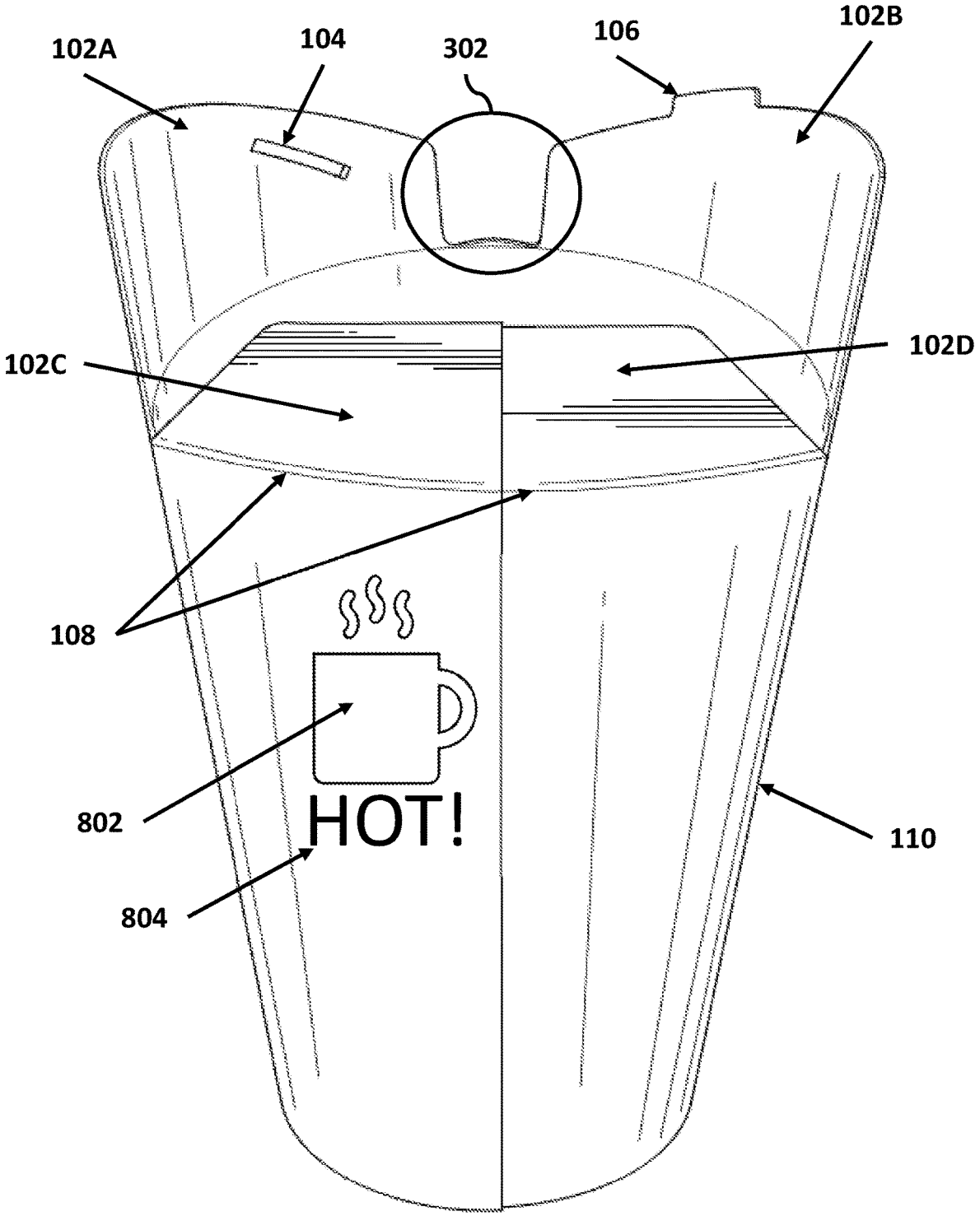
Figure 9:
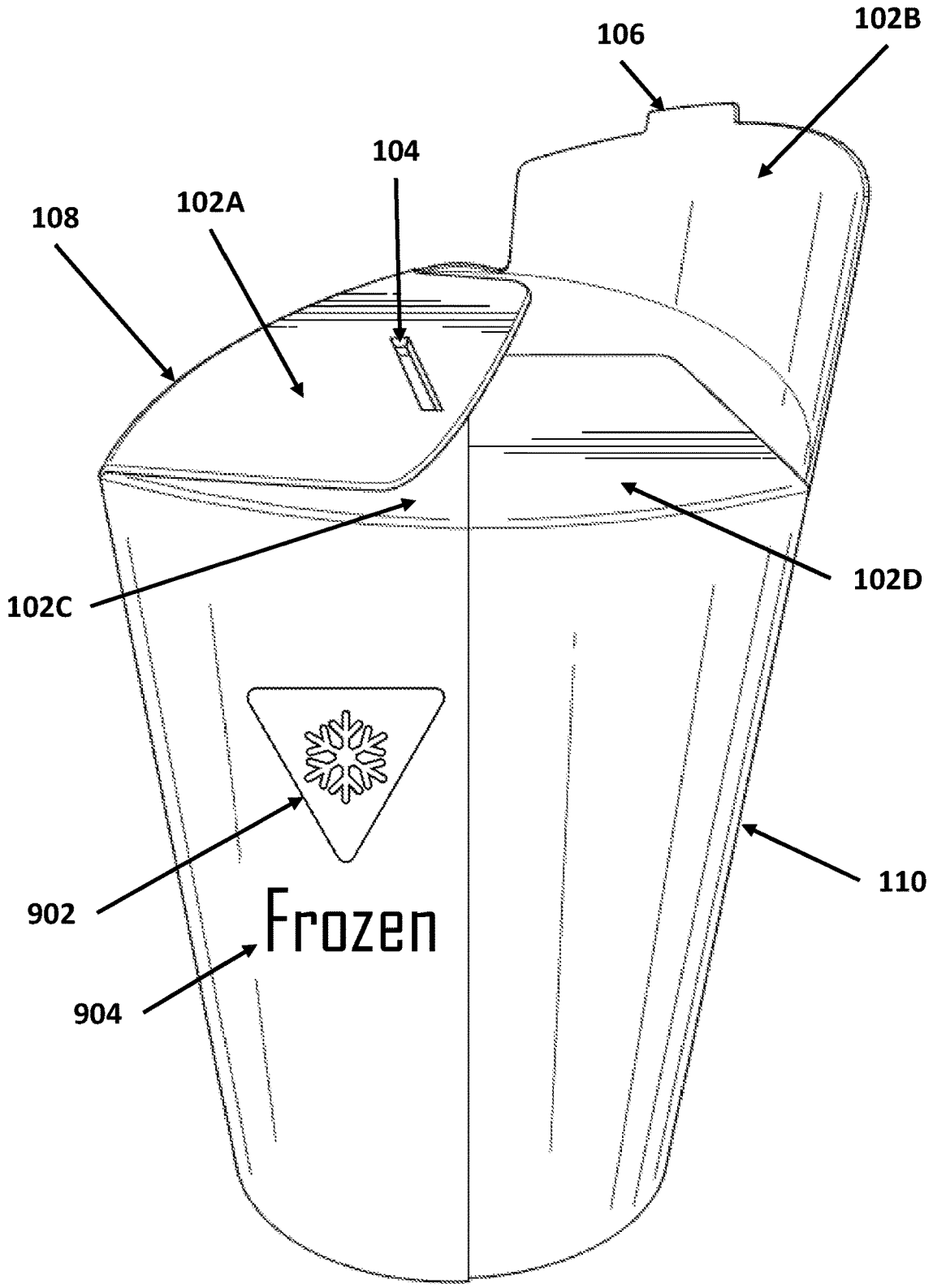
Figure 10:
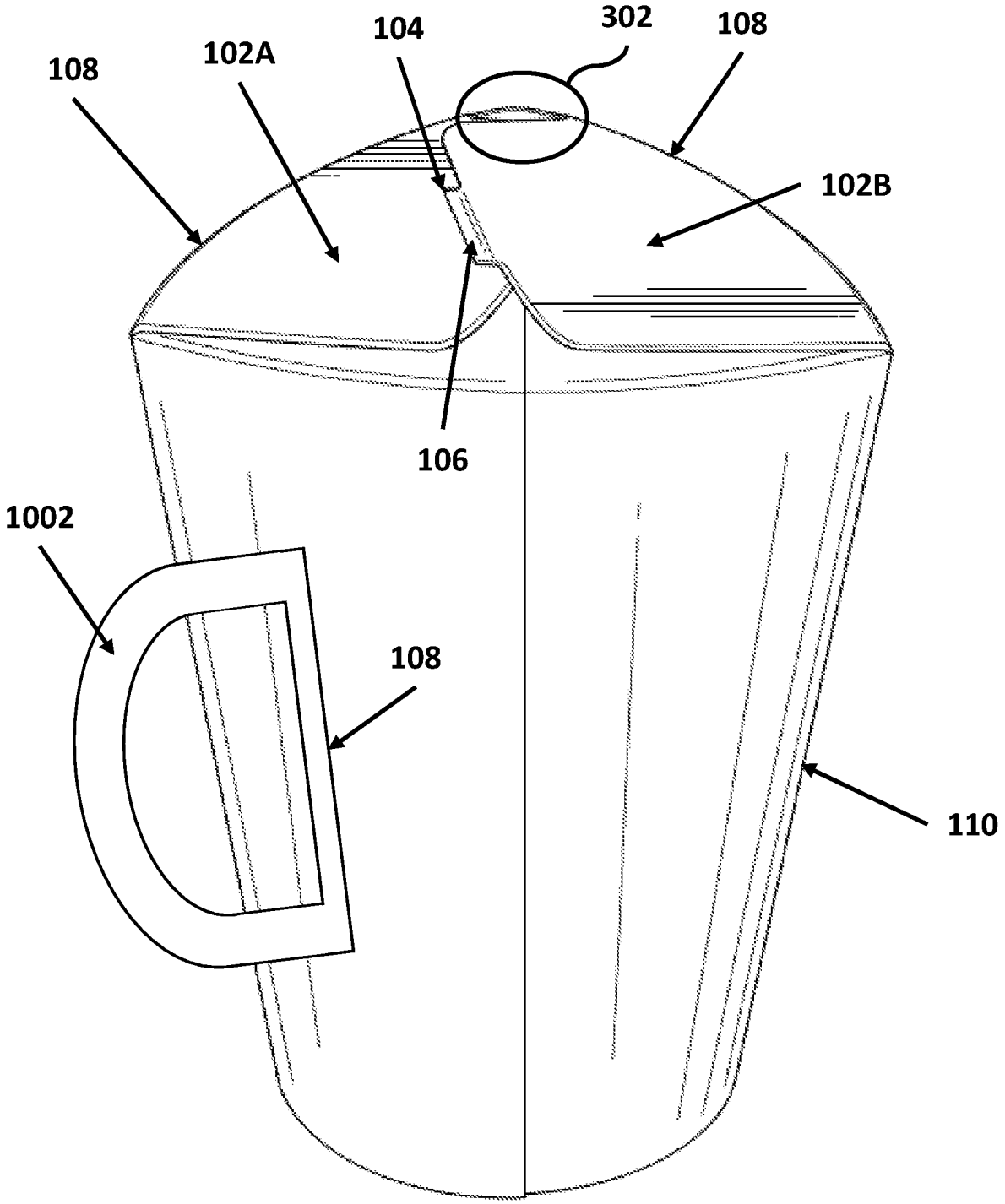

Having thus described embodiments of the disclosure in general terms, reference will now be made to the accompanying drawings, which are not necessarily drawn to scale, and wherein:

FIG. 1 illustrates an example perspective view, according to some embodiments;

FIG. 2 illustrates an example front elevation view, according to some embodiments;

FIG. 3 illustrates an example rear elevation view, according to some embodiments;

FIG. 4 illustrates an example right side elevation view, according to some embodiments;

FIG. 5 illustrates an example left side elevation view, according to some embodiments;

FIG. 6 illustrates an example top-down plane view, according to some embodiments;

FIG. 7 illustrates an example bottom-up plane view, according to some embodiments;

FIG. 8 illustrates an example of a partially-folded plurality of integrated lid sections, according to some embodiments;

FIG. 9 illustrates another example of a partially-folded plurality of integrated lid sections, according to some embodiments;

FIG. 10 illustrates a fully-folded plurality of integrated lid sections, according to some embodiments; and FIGS. 11A, 11B, 11C, and 11D illustrate an example folding procedure, according to some embodiments.

DETAILED DESCRIPTION

Some embodiments of the present invention will now be described more fully hereinafter with reference to the accompanying drawings, in which some, but not all, embodiments of the invention are shown. Indeed, various embodiments of the invention can be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative," "exemplary," and the like are used to be examples with no indication of quality level. As used herein, the term "along," and similarly utilized terms, means near or on, but not necessarily requiring directly on, an edge or other referenced location. Additionally, the term "attachment surface," and similarly utilized terms, means the part of the first component body to which at least one second component is attached, connected, or integrated. As used herein, the term "expandable," and similarly utilized terms, refers to one or more components capable of transitioning between two or more configurations and does not suggest a directionality (e.g., "expandable" may comprise contraction, expansion, or other movement). Further, the terms "angle," "angled," "bend angle," and similarly utilized terms, refer to an angle between zero and 180 degrees. Like reference numerals refer to like elements throughout. Thus, use of any such terms should not be taken to limit the spirit and scope of embodiments of the present invention.

FIG. 1 illustrates an example perspective view in accordance with some example embodiment of an enhanced integrated cup. As depicted, by FIG. 1, the example enhanced integrated cup is shown with a fully open plurality of integrated lid sections 102 extending from the top portion of the sidewall 110. The plurality of integrated lid sections 102 comprises a first integrated lid section 102A configured with a slit 104, a second integrated lid section 102B configured with a tab 106, a third integrated lid section 102C, and a fourth integrated lid section 102D. Slit 104 is configured to receive tab 106 during the folding and interlocking of the plurality of integrated lid sections 102. The third integrated lid section 102C and the fourth integrated lid section 102D are attached (e.g., by adhesive) along seam 103. Seam 103 is defined by the union of a first end 110A of sidewall 110 and a second end 110B of sidewall 110 and extends down the length of sidewall 110 and integrated lid sections 102C and 102D.

The sidewall 110 and the plurality of integrated lid sections 102 are configured with fold lines 108 therebetween. Fold lines 108 are configured to facilitate the folding over of the plurality of integrated lid sections 102 during the folding and interlocking of the plurality of integrated lid sections 102. The placement of fold lines 108 is configured to ensure that the interlocking features (e.g., slit 104 and tab 106) of the plurality of integrated lid sections 102 align properly when folded together. The example enhanced integrated cup is shown with a circular bottom edge 110C defined at least partially by a bottom portion of sidewall 110. The example enhanced integrated cup, as shown in FIG. 1, defines a frustoconical shape with an expanding diameter defined by a circular cross-section increasing from the circular bottom edge 110C along the length of sidewall 110 up until at least fold lines 108. The fully open plurality of integrated lid sections 102 define an opening that provides accessibility to a water tight retention cavity at least partially enclosed by the body of the cup defined by at least sidewall 110. While the illustrated embodiment of FIG. 1 depicts integrated lid section 102B defining a tab as a tab extending from the integrated lid section, according to some embodiments, an integrated lid section may itself define the tab, whereby the integrated lid section extends sufficiently to engage a slit in another integrated lid section configured to receive the integrated lid section defining a tab.

FIG. 2 illustrates an example front elevation view in accordance with some embodiments of a frustoconical shaped enhanced integrated cup body. The example enhanced integrated cup is shown with a fully open plurality of integrated lid sections 102 extending from the top portion of the sidewall 110. As illustrated, by FIG. 2, the frustoconical profile of the enhanced integrated cup body is shown to taper continuously from the top portion comprising the plurality of open integrated lid sections 102 downwards through sidewall 110 until a minimum circular diameter is reached at the circular bottom edge 110C of the sidewall.

FIG. 3 illustrates an example rear elevation view in accordance with some embodiments of enhanced integrated cup body, for example, the frustoconical shaped embodiments illustrated in FIGS. 1-2. FIG. 3 illustrates cutout 302 located between the first integrated lid section 102A, configured with a slit 104, and the second integrated lid section 102B, configured with a tab 106. The plurality of integrated lid sections 102 are depicted in the full open configuration, however, when the plurality of integrated lid sections 102 are in the fully interlocked, or at least partially closed, position then cutout 302 is configured to define an opening, and/or spout, within the integrated lid formed by interlocking the integrated lid sections 102. In some embodiments, cutout 302 may be configured with a straw (not shown) at least attached, therethrough, to a portion of the enhanced integrated cup body. In some embodiments, cutout 302 may be configured with a piece of material (not shown) (e.g., an extension of sidewall 110, integrated lid section 102A, or the like) configured to cover, at least partially, cutout 302. In such embodiments, cutout 302 may be defined, at least partially, by one or more fold lines (not shown) (e.g., a perforated line, etc.) configured around one or more edges of cutout 302. In such embodiments, a user may tear, and/or fold, the piece of material (not shown) along the one or more fold lines (not shown) (e.g., a perforated line, etc.) configured around one or more edges of cutout 302.

FIGS. 4-5 will now be described in terms of relative positioning and as such should not be construed, used, or taken out of the context of FIGS. 4-5 to limit the spirit and scope of embodiments of the present invention or any features described with respect to FIGS. 4-5.

FIG. 4 illustrates an example right side elevation view in accordance with some embodiments of the enhanced integrated cup body. FIG. 4 shows a profile view of cutout 302 located, relatively, to the right the second integrated lid section 102B, configured with a tab 106. The fourth integrated lid section 102D is located, relatively, to the left of the second integrated lid section 102B.

FIG. 5 illustrates an example left side elevation view in accordance with some embodiments of the enhanced integrated cup body. FIG. 5 shows a profile view of cutout 302 located, relatively, to the left of the first integrated lid section 102A, configured with a slit 104. Tab 106 is depicted, relatively, behind and extending above the first integrated lid section 102A. The third integrated lid section 102C is located, relatively, to the right of the first integrated lid section 102A.

FIG. 6 illustrates an example top-down plane view in accordance with some example embodiments. As shown, the interior surface of sidewall 110 defines a single continuous surface extending from the circular base 112 up to and including the fully open plurality of integrated lid sections 102. Circular base 112 is attached to sidewall 110 around base seam 112A. Base seam 112A defines a circumference around circular base 112. Additionally, base seam 112A may attach circular base 112 to sidewall 110 by way of mechanical and/or chemical means. For example, the exterior side of base seam 112A (not shown) may be defined by an edge of circular base 112 being bonded to an edge of sidewall 110 (e.g., circular bottom edge 110C) by way of an epoxy therebetween, and a mechanical crimping of the two edges together to further force the epoxy to at least partially penetrate each respective edge material.

As illustrated, by FIG. 6, at least sidewall 110 and circular base 112 define a retention cavity. In some embodiments, at least sidewall 110 and circular base 112 may be treated with a sealant to define a water tight retention cavity within the interior of the cup. In some embodiments, base seam 112A may be treated with at least the sealant used to treat sidewall 110 and circular base 112 to produce a water tight seam around the circumference of circular base 112. In some embodiments, sidewall 110, circular base 112, and one or more dividers (not shown) may define a plurality of water tight retention cavities within the interior of the enclosed enhanced integrated cup body. Moreover, FIG. 6, illustrates seam 103 between the third integrated lid section 102C and the fourth integrated lid section 102D. In accordance with the example embodiment depicted by FIG. 6, seam 103 is shown to be a lap seam defined by the overlapping edges of sidewall 110 and continued by the overlapping edges of the third integrated lid section 102C and the fourth integrated lid section 102D. Seam 103 is depicted extending the length between base 112 and the top upper edges of the third integrated lid section 102C and the fourth integrated lid section 102D.

FIG. 7 illustrates an example bottom-up plane view in accordance with some example embodiments, for example the exemplary enhanced integrated cup shown in FIG. 6. FIG. 7 illustrates the exterior surfaces of sidewall 110, circular base 112, and the plurality of open integrated lid sections 102. As shown, seam 103 is defined by the overlapping edges of a first end 110A of sidewall 110 and a second end 110B of sidewall 110. Seam 103 extends up the length of sidewall 110 from circular base 112 up to a top portion of integrated lid sections 102C and 102D.

FIG. 8 illustrates an example of a partially-folded plurality of integrated lid sections in accordance with some embodiments. The third integrated lid section 102C and the fourth integrated lid section 102D are illustrated in a folded position. The third integrated lid section 102C and the fourth integrated lid section 102D are folded inward toward the center of the opening defined by the top portion of the cup body. As shown, the third integrated lid section 102C and the fourth integrated lid section 102D are bent substantially at a ninety degree angle to sidewall 110 along fold lines 108. FIG. 8 shows that the first integrated lid section 102A and the second integrated lid section 102B are still in their respective open positions extended upward and being substantially parallel with sidewall 110.

FIG. 8 further illustrates a first graphical design print 802 that comprises a coffee mug logo with three steam lines above the rendering of the mug. Additionally, a second graphical design print 804 is shown that illustrates a plurality of text based characters printed on sidewall 110 spelling out "HOT!" below the first graphical design print 802. In some embodiments, graphical design prints 802 and 804 may be printed in ink on sidewall 110, or applied by other means, while the enhanced integrated cup is still in a flat material form (i.e., a blank).

FIG. 9 illustrates another example of a partially-folded plurality of integrated lid sections in accordance with some embodiments. Similar to the embodiment illustrated in FIG. 8, FIG. 9 depicts the third integrated lid section 102C and the fourth integrated lid section 102D in the folded position. Additionally, the first integrated lid section 102A, configured with slit 104, is illustrated in a folded position. As shown, the first integrated lid section 102A, configured with slit 104, is bent substantially at a ninety degree angle relative to sidewall 110 along fold lines 108. The first integrated lid section 102A, configured with slit 104, is shown overlapping the third integrated lid section 102C and the fourth integrated lid section 102D in the folded position. The second integrated lid section 102B, configured with tab 106, is still in its respective open position. As shown, the second integrated lid section 102B, configured with tab 106, extends upward and is substantially parallel with sidewall 110.

FIG. 9 further illustrates a first graphical design print 902 that comprises a triangle logo with a snowflake logo enclosed by the triangle logo. Additionally, a second graphical design print 904 is shown that illustrates a plurality of text based characters printed on sidewall 110 spelling out "Frozen" below the first graphical design print 902. In some embodiments, graphical design prints 902 and 904 may be vinyl decals (i.e. stickers, etc.) applied with adhesive to sidewall 110 while the enhanced integrated cup is at least partially assembled for use by a consumer. For example, a food service facility may pre-print rolls of graphical design prints indicating, for example, the temperature of the contents of the cup and a food service employee may apply the appropriate graphical design print(s) prior to presenting the cup to a consumer.

FIG. 10 illustrates a fully-folded plurality of integrated lid sections in accordance with some embodiments. Similar to the embodiments illustrated in FIGS. 8-9, FIG. 10 depicts the first integrated lid section 102A, the third integrated lid section 102C, and the fourth integrated lid section 102D in their respective folded positions. Further, FIG. 10 illustrates, the second integrated lid section 102B, configured with tab 106, in a folded position with tab 106 interlocked with at least slit 104 of the first integrated lid section 102A. As shown, the second integrated lid section 102B, configured with tab 106, is bent substantially at a ninety degree angle relative to sidewall 110 along fold lines 108. The plurality of interlocked integrated lid sections 102 and cutout 302 define a drinking opening in the integrated lid of the cup body. FIG. 10 further illustrates a example embodiments of a handle 1002 attached to sidewall 110 of the cup body. In some embodiments, handle 1002 may be configured as a carry handle (not shown) configured to extend over the plurality of interlocked integrated lid sections 102.

Figure 11A:
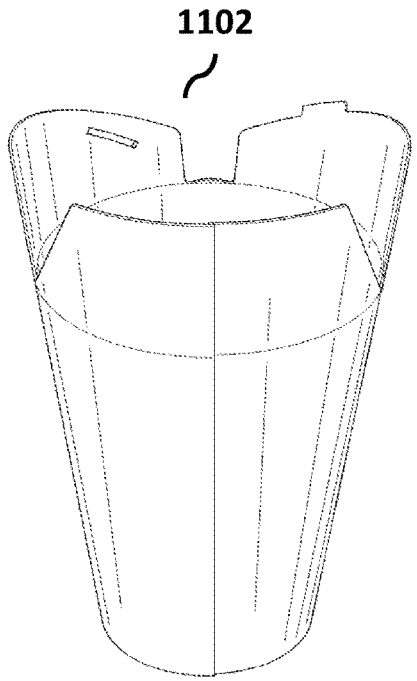
Figure 11B:
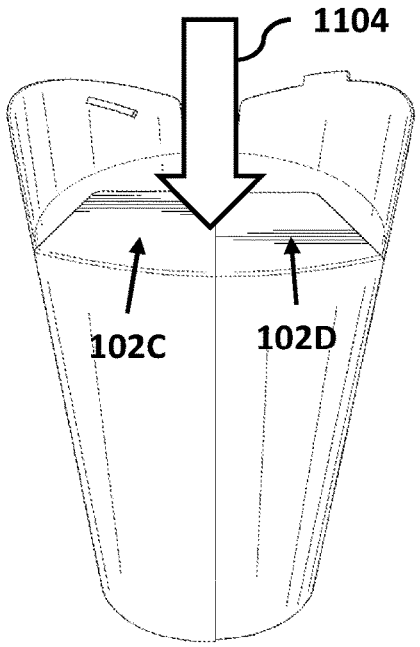
Figure 11C:
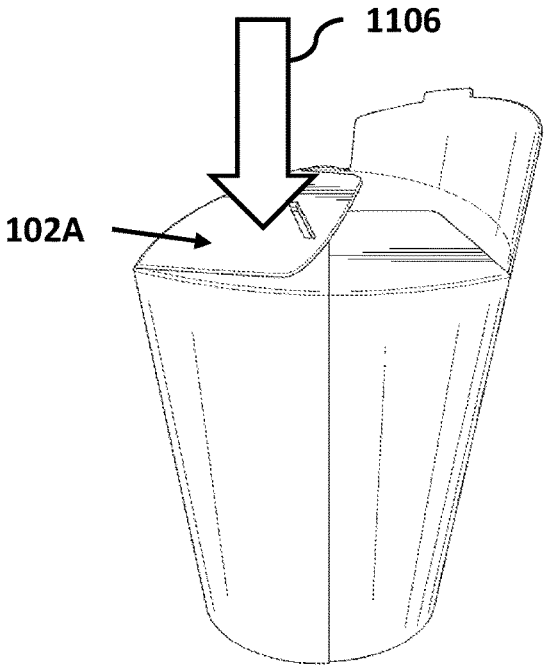
Figure 11D:
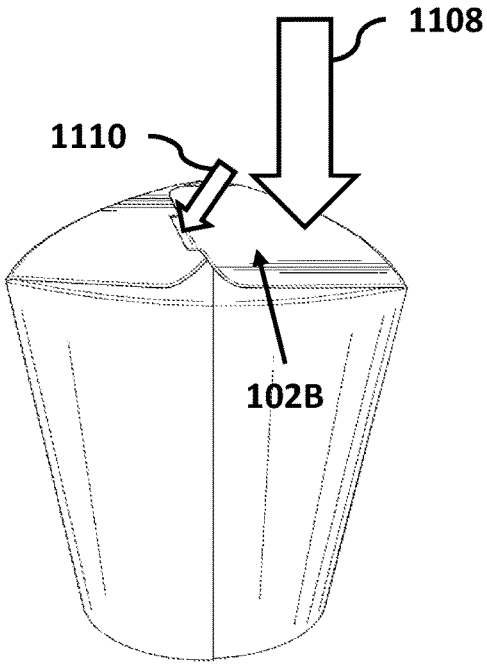

FIGS. 11A, 11B, 11C, and 11D illustrate an example folding procedure in accordance with some embodiments. As depicted, by FIG. 11A, the exemplary enhanced integrated cup 1102 is shown with a fully opened plurality of integrated lid sections extending from the top portion of the sidewall. As shown, by FIG. 11B, step 1104 occurs by folding the third integrated lid section 102C and the fourth integrated lid section 102D down along their respective fold lines and over the interior cavity defined by the cup body. Step 1106 as illustrated in FIG. 11C includes at least the first integrated lid section 102A being folded down along its respective fold line and over the interior cavity defined by the cup body. The first integrated lid section 102A overlaps the third integrated lid section 102C and the fourth integrated lid section 102D. FIG. 11D shows step 1108 that includes at least the second integrated lid section 102B being folded down along its respective fold line and over the interior cavity defined by the cup body. The second integrated lid section 102B further overlaps the integrated lid sections 102A, 102C, and 102D when in its respective folded position. Step 1110 is further shown in FIG. 11D to include at least the insertion of tab 106, of the second integrated lid section 102B, into slit 104, of the first integrated lid section 102A.

In some embodiments, the fully opened plurality of integrated lid sections may be first bent outward to provide easier access to the interior cavity of the cup body (e.g., to insert a food product, beverage, etc.) before being bent inward to interlock the plurality of integrated lid sections, such as described with respect to at least FIGS. 11A, 11B, 11C, and 11D. In some embodiments, the interlocked plurality of integrated lid sections may define a flat, convex or concave shape. For example, the interlocked plurality of integrated lid sections may bend inward toward the bottom of the cup body (i.e. the circular base) to define a concave lid. For additional example, the interlocked plurality of integrated lid sections may bend outward away from the bottom of the cup body (i.e. the circular base) to define a convex lid. In some embodiments, the plurality of integrated lid sections may comprise one or more of mechanical or chemical means to provide a water tight lid. For example, one or more integrated lid sections may be configured with a pressure activated chemical adhesive, or the like, on at least one of their respective exterior surfaces that is configured to attach to another one or more integrated lid sections when the plurality of integrated lid sections are interlocked with each other. In some example embodiments, the interior surfaces of the plurality of integrated lid sections may be treated with additional sealant material to prevent leakage through the seams defined by the plurality of interlocked integrated lid sections.

While some embodiments described herein relate to food and beverage containers (e.g., drinking cups), and other particular containers, one of ordinary skill in the art will appreciate that the teachings herein may also apply to a wide range of additional containment, storage, and transportation applications. Some such additional applications include: delivery containers for online purchases, delivery containers for fast food delivery and/or takeout, commercial or personal shipping containers (e.g., mailing boxes, etc.), retail packages for appliances and electronics, storage bins (e.g., laundry bins, tote boxes, toy boxes, etc.), pet applications (e.g., pet carriers, kennels, gold fish carriers, etc.), rubbish receptacles (e.g., garbage cans, recycling bins, dumpsters, ashtrays, etc.), construction applications (e.g., concrete molds, casts, forms, equipment storage, tool boxes, etc.), manufacturing applications (e.g., hardware packaging for screws, nuts, bolts, etc.), toy applications (e.g., packaging for fast food meal toys or arcade claw machine prizes, etc.), the like, or combinations thereof.

The embodiments described herein may be scalable to accommodate at least the aforementioned applications. Various components of embodiments described herein can be added, removed, modified, and/or duplicated as one skilled in the art would find convenient and/or necessary to implement a particular application in conjunction with the teachings of the present disclosure. In some embodiments, specialized features, characteristics, materials, components, and/or equipment may be applied in conjunction with the teachings of the present disclosure as one skilled in the art would find convenient and/or necessary to implement a particular application.

Moreover, many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

That which is claimed is:

1. A cup with an integrated folding lid, comprising:

a body comprising one or more materials, the body comprises one or more fold lines that when the body is bent along the one or more fold lines the body comprises:

a center portion defining a sidewall, the sidewall extending between a first end and a second end, the first end of the sidewall attached to the second end of the sidewall along a seam;

a circular bottom portion extending from the center portion defining a base, the circular bottom portion configured to extend from the sidewall in a first direction and attach to a bottom edge;

a top portion defining an opening;

a folding portion extending from the top portion and separated from the top portion by a fold line, the folding portion forming a plurality of integrated lid sections in response to the folding portion being folded along the fold line, wherein the plurality of integrated lid sections cooperate to substantially cover the opening;

a piece of material attached to at least one of the plurality of integrated lid sections at a fold line;

a cutout formed through the at least one of the plurality of integrated lid sections, wherein the piece of material at least partially covers the cutout, wherein the cutout provides access to contents of the cup through the at least one of the plurality of integrated lid sections in response to folding the piece of material relative to the at least one of the plurality of integrated lid sections, wherein the cutout provides access to contents of the cup in response to tearing of the piece of material at the fold line; and at least one graphical design printed on the cup identifying a location of the fold line.

2. The cup according to claim 1, wherein the plurality of integrated lid sections are formed in response to the folding portion being folded along the fold line and a plurality of lid section fold lines there between.

3. The cup according to claim 1, further comprising at least one graphical design printed on the cup indicating an order of folding of the plurality of integrated lid sections to substantially cover the opening.

4. The cup according to claim 1, wherein at least one integrated lid section defines a tab and at least one integrated lid section defines a slit, the slit is configured to receive there through the tab.

5. The cup according to claim 4, wherein the plurality of integrated lid sections are configured to interlock at least by way of the tab being received within the slit.

6. The cup according to claim 1, wherein the plurality of integrated lid sections, folded to substantially cover the opening, define an opening through the plurality of integrated lid sections.

7. The cup according to claim 1, wherein the plurality of integrated lid sections comprises a first integrated lid section defining a tab, a second integrated lid section defining a slit, a third integrated lid section, and a fourth integrated lid section, wherein the slit is configured to receive there through the tab, wherein the plurality of integrated lid sections are configured to interlock at least by way of the tab being received within the slit, and wherein the plurality of integrated lid sections define a lid cover configured to at least partially cover the opening when interlocked.

8. The cup according to claim 1, wherein the piece of material of the one or more of the plurality of integrated lid sections or the top portion is attached to the one or more of the plurality of integrated lid sections or the top portion at a fold line.

9. A cup with an integrated folding lid comprising:

a center portion defining a sidewall, the sidewall extending between a first end and a second end, the first end of the sidewall attached to the second end of the sidewall along a seam;

a bottom portion extending from the center portion and defining a base;

a top portion defining an opening;

a folding portion extending from the top portion and separated from the top portion by a fold line, wherein the folding portion, in a folded position, forms a plurality of integrated lid sections to define a lid cover configured to at least partially cover the opening, a piece of material attached to at least one of the plurality integrated lid sections;

a cutout is defined through the at least one of the plurality of integrated lid sections, wherein the piece of material at least partially covers the cutout, wherein the cutout provides access to contents of the cup through the at least one of the plurality of integrated lid sections in response to folding the piece of material relative to the at least one of the plurality of integrated lid sections, wherein the cutout provides access to contents of the cup in response to tearing of the piece of material, and wherein the cutout is configured to receive at least one of a straw, utensil, or stirrer.

10. The cup according to claim 9, wherein the plurality of integrated lid sections are configured with lid section fold lines therebetween.

11. The cup according to claim 9, wherein the cutout is formed between the folding portion and the sidewall.

12. The cup according to claim 9, further comprising at least one graphical design printed on the cup identifying a location of the fold line.

13. The cup according to claim 9, wherein at least one integrated lid section defines a tab and at least one integrated lid section defines a slit, the slit is configured to receive there through the tab, wherein the plurality of integrated lid sections are configured to interlock at least by way of the tab being received within the slit.

14. The cup according to claim 9, wherein the piece of material of one or more of the plurality integrated lid sections or the top portion is attached to the one or more of the plurality of integrated lid sections or the top portion at a fold line.

15. A cup with an integrated folding lid comprising:

a center portion defining a sidewall, the sidewall extending between a first end and a second end, the first end of the sidewall attached to the second end of the sidewall along a seam;

a bottom portion extending from the center portion and defining a base;

a top portion defining an opening;

a folding portion extending from the top portion and separated from the top portion by a fold line;

a piece of material of one or more of the folding portion or the top portion;

a cutout, wherein the piece of material at least partially covers the cutout; and at least one graphical design printed on the cup identifying one or more of: a location of the fold line or an order of folding of the folding portion to substantially cover the opening, wherein the folding portion, in a folded position, forms a plurality of integrated lid sections to define a lid cover configured to at least partially cover the opening, wherein the cutout is formed through at least one of the plurality of integrated lid sections, wherein the cutout provides access to contents of the cup through the at least one of the plurality of integrated lid sections in response to folding the piece of material relative to the at least one of the plurality of integrated lid sections, wherein the piece of material is attached to the at least one of the plurality of integrated lid sections, wherein the cutout provides access to contents of the cup in response to tearing of the piece of material.

16. The cup according to claim 15, wherein the plurality of integrated lid sections are configured with lid section fold lines therebetween.

17. The cup according to claim 15, wherein at least one integrated lid section defines a tab and at least one integrated lid section defines a slit, the slit is configured to receive there through the tab, wherein the plurality of integrated lid sections are configured to interlock at least by way of the tab being received within the slit.

* * * * *